US006769330B2

(12) United States Patent
Chang

(10) Patent No.: US 6,769,330 B2
(45) Date of Patent: Aug. 3, 2004

(54) RATCHET WRENCH HAVING A SIMPLIFIED PAWL BIASING DEVICE

(76) Inventor: Hsuen Chen Chang, P.O. Box 65-45, Taichung (TW), 403

( * ) Notice: Subject to any disclaimer, the term of this patent is extended or adjusted under 35 U.S.C. 154(b) by 155 days.

(21) Appl. No.: 10/261,305

(22) Filed: Sep. 27, 2002

(65) Prior Publication Data

US 2003/0136231 A1 Jul. 24, 2003

Related U.S. Application Data

(63) Continuation-in-part of application No. 10/054,382, filed on Jan. 24, 2002, now abandoned.

(51) Int. Cl.[7] ..... B25B 13/46
(52) U.S. Cl. ..... 81/60; 192/43.1
(58) Field of Search ..... 81/60–63.2; 192/43.1, 192/43.2

(56) References Cited

U.S. PATENT DOCUMENTS

| | | | | | |
|---|---|---|---|---|---|
| 3,044,591 | A | * | 7/1962 | Kilness | 192/43.1 |
| 4,063,626 | A | | 12/1977 | Solomon | 192/43.1 |
| 4,497,227 | A | * | 2/1985 | Stasiek | 81/63.1 |
| 4,762,033 | A | | 8/1988 | Chow | 81/63.2 |
| 5,916,339 | A | | 6/1999 | Dumont | 81/63.1 |
| 6,044,731 | A | | 4/2000 | Hsieh | 81/63.2 |
| 6,205,891 | B1 | | 3/2001 | Huang et al. | 81/63.1 |
| 6,220,123 | B1 | | 4/2001 | Chen | 81/63.2 |
| 6,615,693 | B1 | * | 9/2003 | Liao | 81/60 |

* cited by examiner

*Primary Examiner*—D. S. Meislin

(57) ABSTRACT

A ratchet wrench includes a driving head having an inner peripheral gear, a wheel rotatably engaged in the driving head and having two openings formed in the outer peripheral portion. Two pawls are received in the openings of the wheel and each has a number of outer teeth for engaging with the inner peripheral gear of the driving head, and each has one end for being biased to engage into the end portions of the openings of the wheel by two springs, for greatly increasing the driving torque of the driving head to the wheel. The wheel has an engaging hole for receiving fasteners.

1 Claim, 4 Drawing Sheets

RATCHET WRENCH HAVING A SIMPLIFIED PAWL BIASING DEVICE

The present invention is a continuation-in-part of U.S. patent application Ser. No. 10/054,382, filed Jan. 24, 2002, abandoned.

BACKGROUND OF THE INVENTION

1. Field of the Invention

The present invention relates to a ratchet wrench, and more particularly to a ratchet wrench having a simplified pawl biasing device.

2. Description of the Prior Art

Various kinds of typical ratchet wrenches have been developed and used today. U.S. Pat. No. 4,063,626 to Solomon, U.S. Pat. No. 4,762,033 to Chow, U.S. Pat. No. 5,916,339 to Dumont, and U.S. Pat. No. 6,205,891 to Huang et al. disclose four of the typical ratchet wrenches and each includes a driving stud provided on one end for fastener driving purposes. The driving head may not be disposed up-side-down such that a driving direction control device is further required to be engaged into the driving head and the handle for controlling or switching the operational directions of the driving stud.

U.S. Pat. No. 6,044,731 to Hsieh, and U.S. Pat. No. 6,220,123 to Chen disclose the other typical ratchet wrenches each including a ratchet wheel having an engaging hole provided therein for receiving fasteners. However, a single pawl is disposed in a cavity formed in the driving head and engaged with the ratchet wheel for controlling or switching the operational directions of the driving head. The formation of the cavity in the driving head may greatly decrease the strength of the driving head. In addition, the engagement of the single pawl with the ratchet wheel and the driving head is weak, such that the driving torque of the driving head against the ratchet wheel may not be increased or maintained.

The present invention has arisen to mitigate and/or obviate the afore-described disadvantages of the conventional ratchet wrenches.

SUMMARY OF THE INVENTION

The primary objective of the present invention is to provide a ratchet wrench including a simplified pawl biasing device for effectively actuating and operating the pawl.

In accordance with one aspect of the invention, there is provided a ratchet wrench comprising a driving head including a chamber formed therein, and including an inner peripheral gear provided therein, and including an upper and a lower peripheral shoulders formed therein. A wheel is rotatably engaged in the chamber of the driving head, and includes a barrel having an engaging hole formed therein for receiving an object to be driven by the ratchet wrench, and includes an outer peripheral portion having a pair of opposite openings formed therein. The openings of the wheel each includes an end portion. The wheel includes a first end having a peripheral flange extended radially outward therefrom for engaging with the lower peripheral shoulder of the driving head and for rotatably securing the wheel to the driving head. The wheel including a second end having a peripheral fence extended upwardly from the barrel, the peripheral fence includes an outer diameter smaller than that of the barrel for forming a peripheral shoulder between the barrel and the fence, the peripheral fence of the wheel includes an outer peripheral portion having an outer peripheral groove formed therein. The wheel includes two orifices formed in the second end thereof and offset from the openings thereof. A first and a second pawls are received in the openings of the wheel respectively, and each includes an upper portion having an aperture formed therein, and each includes an outer peripheral portion having a plurality of teeth formed thereon for engaging with the inner peripheral gear of the driving head, and each includes a first end for engaging into the end portions of the openings of the wheel respectively. A first and a second spring biasing members are received in the peripheral shoulder formed between the barrel and the fence, and each includes a first end engaged into the apertures of the first and the second pawls respectively, and each includes a second end engaged into the orifices of the wheel respectively, for biasing the first ends of the first and the second pawls into the end portions of the openings of the wheel respectively, and to determine a driving direction of the driving head to the wheel. A clamping ring is engaged into the upper peripheral shoulder of the wheel, and includes a bore formed therein for receiving the peripheral fence of the wheel, and includes a peripheral rib extended into the bore thereof for engaging into the peripheral groove of the peripheral fence and for rotatably securing the wheel to the driving head.

The engagement of the two pawls in the end portions of the openings of the wheel may increase the driving torque of the driving head to the wheel. In addition, the outer peripheral teeth of of the pawls may also be engaged with the inner peripheral gear of the driving head, such that the wheel may be solidly rotated and driven by the driving head with a greatly increased driving torque.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
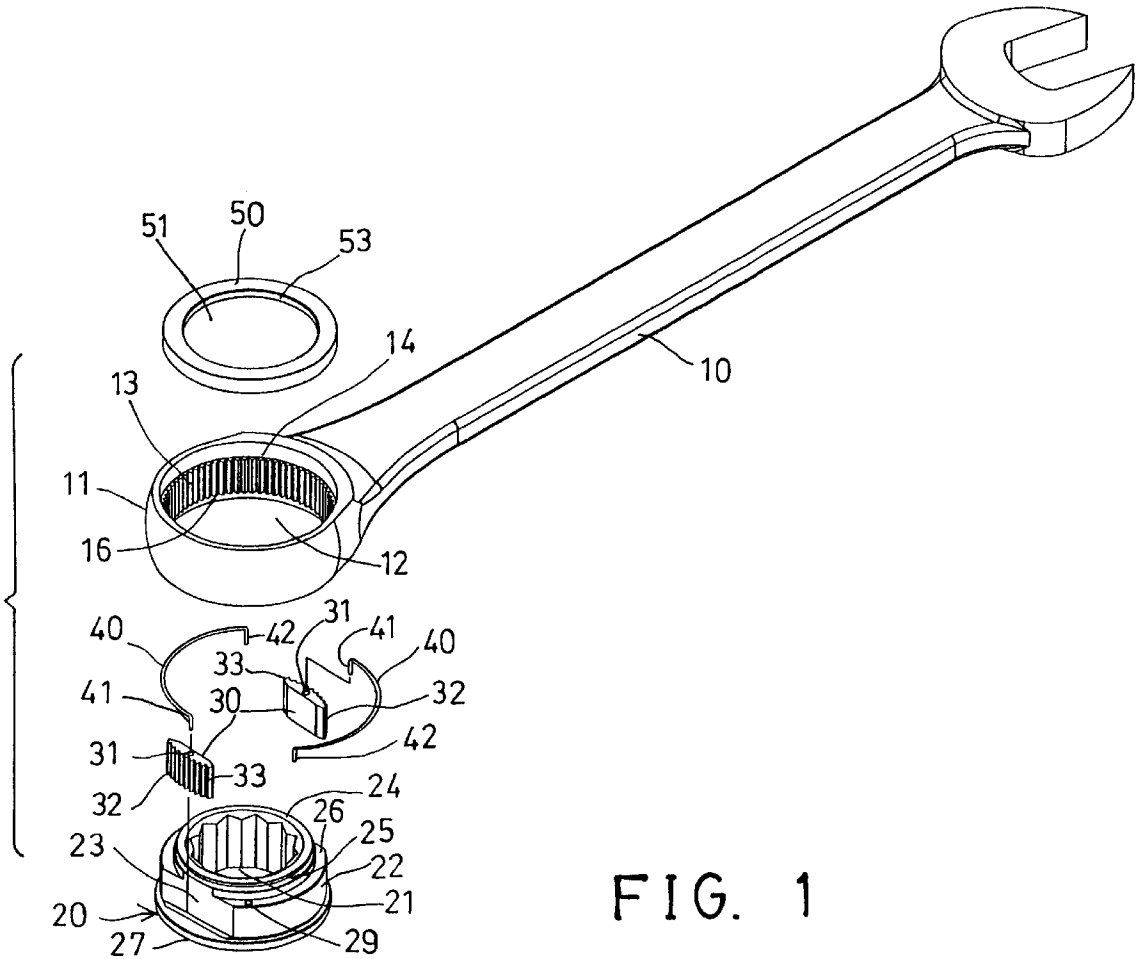
FIG. 1 is an exploded view of a ratchet wrench in accordance with the present invention.
Figure 2:
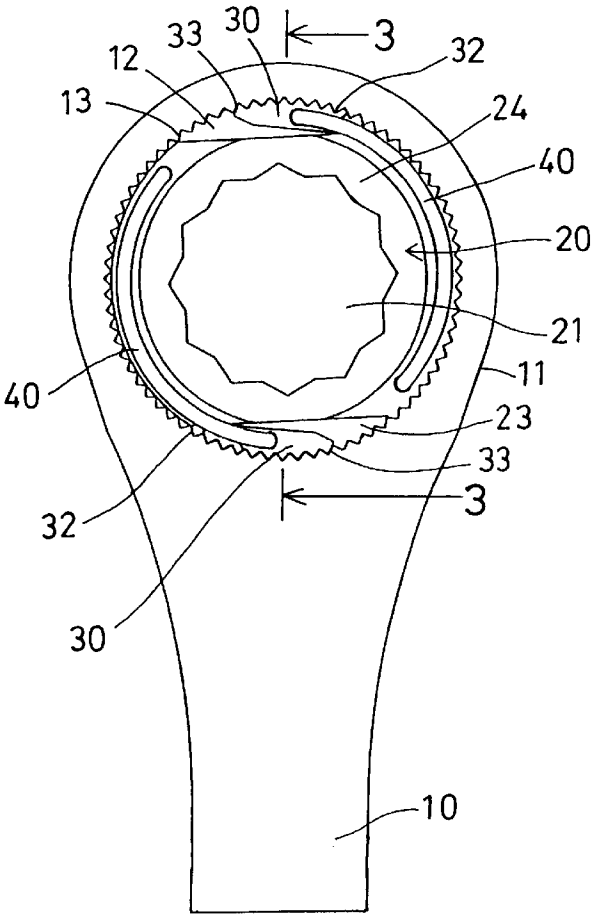
FIG. 2 is a partial top plan schematic view of the ratchet wrench, in which the clamping ring has been removed for clearly showing the inner structure of the ratchet wrench.

Referring to the drawings, and initially to FIGS. 1 and 2, a ratchet wrench in accordance with the present invention comprises a handle 10 including a driving head 11 formed or provided on one end thereof and having a chamber 12 formed therein, and having an inner ratchet gear 13 formed or provided in the driving head 11.

Figure 3:
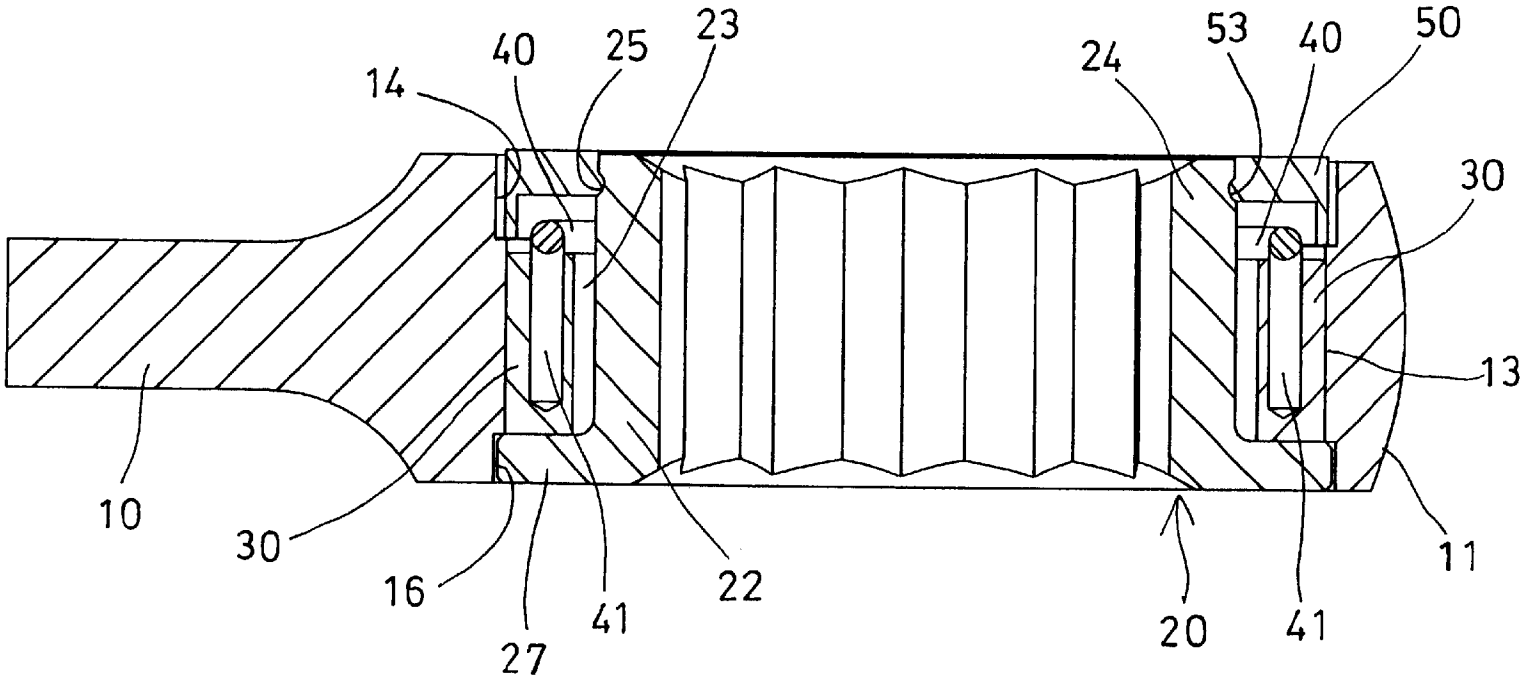
FIG. 3 is a partial cross sectional view taken along lines 3—3 of FIG. 2.

As best shown in FIG. 3, the inner ratchet gear 13 is preferably extended radially into the chamber 12 of the driving head 11, for forming or defining an inner peripheral shoulder 14, 16 formed in the upper portion and the lower portion thereof respectively.

A wheel, such as a ratchet wheel 20 includes a cylindrical barrel 22 rotatably engaged in the chamber 12 of the driving head 11, and includes a pair of opposite cut-off portions or openings 23 formed in the outer peripheral portion thereof.

The wheel 20 includes a peripheral fence 24 extended upward therefrom and having an outer diameter smaller than that of the barrel 22, for forming or defining a peripheral shoulder 26 between the barrel 22 and the fence 24. The peripheral fence 24 of the wheel 20 preferably includes an outer peripheral groove 25 formed in the outer peripheral portion thereof.

The wheel 20 further includes a peripheral flange 27 radially extended outward from the bottom portion thereof for engaging in the lower peripheral shoulder 16 of the driving head 11 and for rotatably securing the wheel 20 to the driving head 11 and for preventing the wheel 20 from being disengaged from the driving head 11.

The wheel 20 includes an engaging hole 21 formed therein for receiving fasteners or other tool members therein, and includes a pair of opposite orifices 29 formed in the barrel 22 and communicating with the peripheral shoulder 26 of the wheel 20, and offset from the openings 23 of the wheel 20.

A pair of pawls 30 are slidably engaged in the openings 23 of the wheel 20 respectively and each includes an aperture 31 formed in the upper and center portion thereof, and each includes two or more ends or end teeth 32, 33 or a number of teeth 32, 33 formed in the outer peripheral portion thereof, for selectively engaging with the inner ratchet gear 13 of the driving head 11, and for controlling the driving direction of the wheel 20 by the driving head 11.

A pair of spring members or spring biasing devices 40 each includes one bent end 41 engaged into the aperture 31 of the pawl 30 respectively, and each includes the other bent end 42 engaged with the orifice 29 of the wheel 20 respectively, for applying a spring biasing force against the pawls 30.

For example, the spring biasing devices 40 may bias or force the pawls 30 toward one end of the respective openings 12, for biasing one end of the pawls 30 to be engaged between the wheel 20 and the driving head 11, and for biasing the ends 32 of the pawls 30 to engage with the ratchet teeth 13 of the driving head 11.

Figure 4:
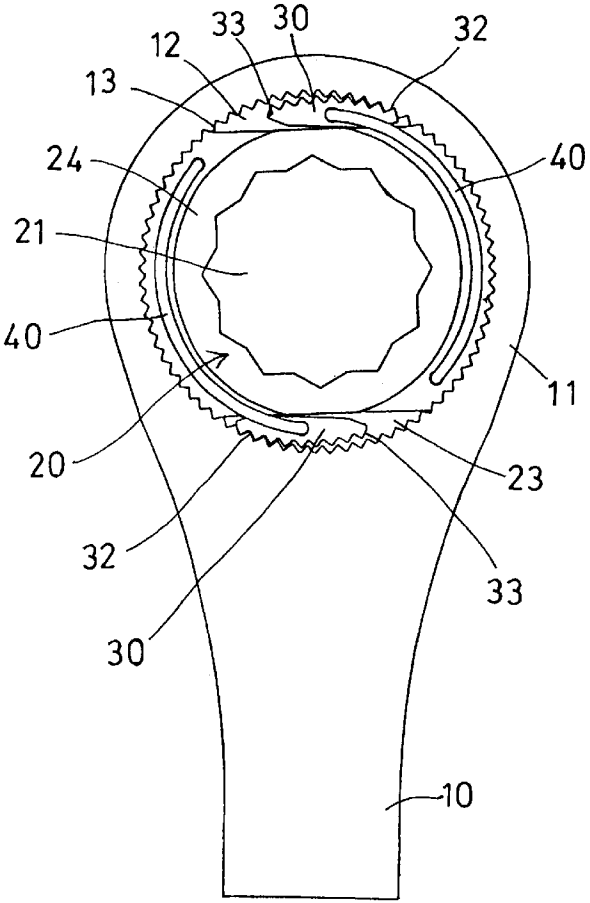
FIG. 4 is a partial top plan schematic view similar to FIG. 2, illustrating the operation of the ratchet wrench.

As best shown in FIGS. 2 and 4, the peripheral fence 24 of the wheel 20 includes an outer diameter smaller than that of the barrel 22, for forming or defining a peripheral shoulder 26 between the barrel 22 and the fence 24, and/or for forming or defining an annular or peripheral space 26 between the fence 24 and the driving head 11 for receiving the spring biasing devices 40.

As also best shown in FIGS. 2 and 4, the opposite cut-off portions or openings 23 are formed in the outer peripheral portion of the wheel 20, and may also be formed between the wheel 20 and the driving head 11, and each including a wider middle portion and each including one or more end portions having a reduced width for receiving either of the ends 32 of the pawls 30 and for allowing the ends 32 of the pawls 30 to be solidly engaged between the wheel 20 and the driving head 11.

A clamping ring 50 is engaged in the upper peripheral shoulder 14 of the driving head 11 and includes a bore 51 formed therein for receiving the fence 24 of the wheel 20, and includes a peripheral rib 53 extended radially into the bore 51 thereof, for rotatably securing the wheel 20 to the driving head 11 and for preventing the wheel 20 from being disengaged from the driving head 11.

As best shown in FIG. 3, the radially and outwardly extended peripheral flange 27 of the wheel 20 may be engaged in the lower peripheral shoulder 16 of the driving head 11, and clamping ring 50 may be engaged in the upper peripheral shoulder 14 of the driving head 11 and may be engaged with the driving head 11, for rotatably securing the wheel 20 to the driving head 11.

In operation, the pawls 30 may be moved or caused to move toward one of the two ends of the opening 23 of the barrel 22 to engage with the inner ratchet gear 13 of the driving head 11 by the spring biasing devices 40 and/or by rotating the wheel 20 relative to the driving head 11.

As shown in FIG. 2, when the wheel 20 is engaged onto a fastener or the like, or when the fastener is engaged into the engaging hole 21 of the wheel, and when the handle 10 is rotated clockwise, the ends 32 of the pawls 30 may be forced to be solidly engaged with the inner ratchet gear 13 of the driving head 11, and to be solidly engaged between the wheel 20 and the driving head 11, such that the wheel 20 may be rotated or driven clockwise by the driving head 11.

As shown in FIG. 4, when the handle 10 is rotated counterclockwise, the pawls 30 may be moved toward the wider middle portion of the openings 23 of the wheel 20, against the spring biasing devices 40 respectively, and may be disengaged form the inner ratchet gear 13 of the driving head 11, such that the wheel 20 may not be rotated or driven counterclockwise by the driving head 11, and such that the handle 10 and the driving head 11 may rotate freely counterclockwise relative to the wheel 20, with a ratchet operation.

Figure 5:
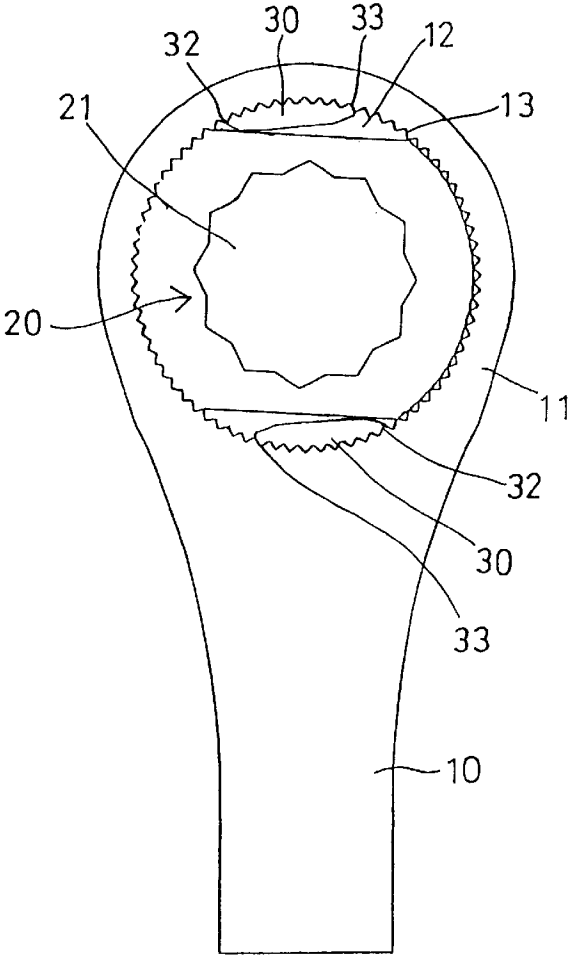
FIGS. 5, 6 are partial top plan schematic views similar to FIGS. 2 and 4, illustrating the operation of the ratchet wrench when the ratchet wrench is disposed up-side-down and when a portion of the wheel has been removed for clearly showing the inner structure of the ratchet wrench.
Figure 6:
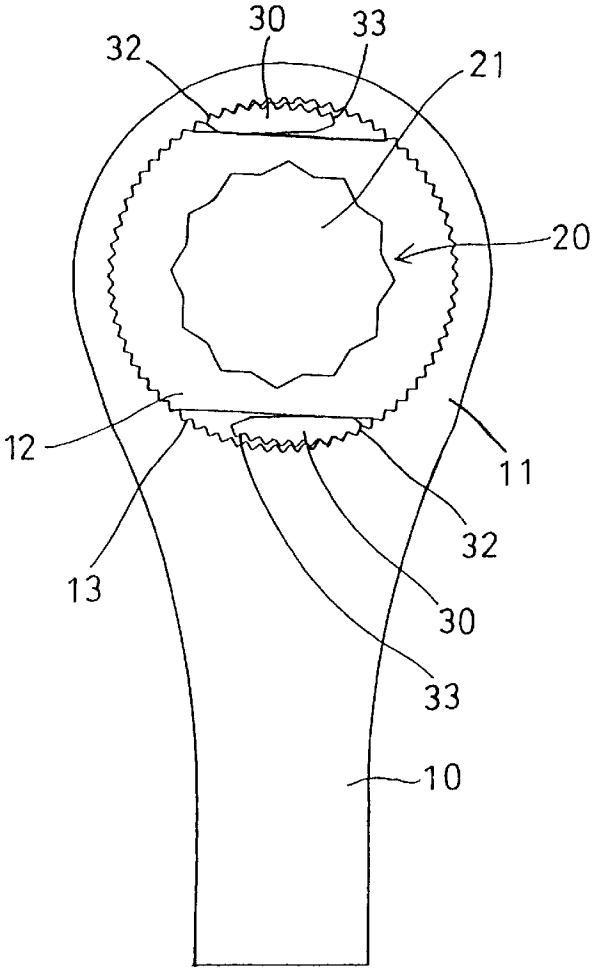

As shown in FIGS. 5 and 6, when the handle 10 and the driving head 11 are disposed up-side-down, the wheel 20 may be rotated and driven counterclockwise by the driving head 11, due to the engagement of the ends 32 of the pawls 30 in the end portions of the openings 23 of the wheel 20. The driving head 11 may rotate clockwise freely relative to the wheel (FIG. 6) with the ratchet operation.

It is to be noted that the two pawls 30 may have most or all of its teeth 32, 33 solidly engaged with the inner peripheral ratchet gear 13 of the driving head 11 (FIGS. 2, 5) when the end portions of the pawls 30 are solidly engaged between the wheel 20 and the driving head 11, such that the driving torque of the driving head 11 against the wheel 20 may be greatly increased.

In addition, no driving direction actuating or selecting devices are provided in the driving head 11 and/or in the wheel 20 as those required by the typical ratchet wrenches, and no further holes or notches are required to be formed in the driving head 11 and the wheel 20, such that the wheel 20 and the driving head 11 may have greater thickness, and may have stronger bodies.

Furthermore, relatively fewer parts or elements are required to be provided or manufactured or assembled between the driving head 11 and the wheel 20, such that the ratchet wrench may be easily and quickly manufactured with greatly reduced costs and man power.

In addition, the spring biasing devices 40 may be stably retained in the annular or peripheral spaces formed or defined by the peripheral space 26 of the wheel 20, or formed or defined between the fence 24 and the driving head 11, and may further be stably retained in place by the clamping ring 50, such that the spring biasing devices 40 may be stably coupled to the pawls 30 for biasing the ends 32 of the pawls 30 toward one end of the openings 23 of the wheel 20.

Accordingly, the ratchet wrench in accordance with the present invention includes a simplified pawl biasing device for effectively actuating and operating the pawl.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a driving head including a chamber formed therein, and including an inner peripheral gear provided therein, and including an upper and a lower peripheral shoulders formed therein, a wheel rotatably engaged in said chamber of said driving head, and including a barrel having an engaging hole formed therein for receiving an object to be driven by said ratchet wrench, and including an outer peripheral portion having a pair of opposite openings formed therein, said openings of said wheel each including an end portion, said wheel including a first end having a peripheral flange extended radially outward therefrom for engaging with said lower peripheral shoulder of said driving head and for rotatably securing said wheel to said driving head, said wheel including a second end having a peripheral fence extended upwardly from said barrel, said peripheral fence including an outer diameter smaller than that of said barrel for forming a peripheral shoulder between said barrel and said fence, said peripheral fence of said wheel including an outer peripheral portion having an outer peripheral groove formed therein, said wheel including two orifices formed in said second end thereof and offset from said openings thereof, a first and a second pawls received in said openings of said wheel respectively, and each including an upper portion having an aperture formed therein, and each including an outer peripheral portion having a plurality of teeth formed thereon for engaging with said inner peripheral gear of said driving head, and each including a first end for engaging into said end portions of said openings of said wheel respectively, a first and a second spring biasing members received in said peripheral shoulder formed between said barrel and said fence, and each including a first end engaged into said apertures of said first and said second pawls respectively, and each including a second end engaged into said orifices of said wheel respectively, for biasing said first ends of said first and said second pawls into said end portions of said openings of said wheel respectively, and to determine a driving direction of said driving head to said wheel, and a clamping ring engaged into said upper peripheral shoulder of said wheel, and including a bore formed therein for receiving said peripheral fence of said wheel, and including a peripheral rib extended into said bore thereof for engaging into said peripheral groove of said peripheral fence and for rotatably securing said wheel to said driving head.

* * * * *